United States Patent [19]

Yamaguchi

[11] Patent Number: 4,952,086

[45] Date of Patent: Aug. 28, 1990

[54] PRINTER WITH FEED REEL AND TAKE-UP REEL WINDING

[75] Inventor: Kouzou Yamaguchi, Kashihara, Japan

[73] Assignee: Sharp Kabushiki Kaisha, Japan

[21] Appl. No.: 442,488

[22] Filed: Nov. 27, 1989

Related U.S. Application Data

[63] Continuation of Ser. No. 181,315, Apr. 13, 1988, abandoned.

[30] Foreign Application Priority Data

Apr. 13, 1987 [JP] Japan ..... 62-90412

[51] Int. Cl.[5] ..... B41J 31/14

[52] U.S. Cl. ..... 400/223; 400/208

[58] Field of Search ..... 400/233, 234, 224.2, 400/230, 218, 223, 208, 208.1

[56] References Cited

U.S. PATENT DOCUMENTS

| | | | |
|---|---|---|---|
| 4,000,804 | 1/1977 | Zaltieri | 400/234 |
| 4,264,224 | 4/1981 | Mathews | 400/234 |
| 4,420,268 | 12/1983 | Tsukamura et al. | 400/233 |
| 4,577,199 | 3/1986 | Saiki et al. | 400/224.2 |
| 4,611,937 | 9/1986 | Sato et al. | 400/234 |
| 4,621,270 | 11/1986 | Mizutani et al. | 400/233 |
| 4,629,346 | 12/1986 | Surti | 400/208 |
| 4,798,487 | 1/1989 | Hattori et al. | 400/223 |

FOREIGN PATENT DOCUMENTS

| | | | |
|---|---|---|---|
| 201675 | 12/1982 | Japan | 400/120 |
| 217384 | 12/1983 | Japan | 400/233 |
| 120085 | 6/1985 | Japan | 400/233 |

*Primary Examiner*—Eugene H. Eickholt

[57] ABSTRACT

A printer has a ribbon cassette with an ink ribbon wound between a feed reel and a take-up reel mounted in a stationary state independently of a carriage, so that the ink ribbon may be let off from the ribbon cassette and is recovered into the ribbon cassette by means of a print head mounted on the carriage along with the movement of the carriage in the printing direction, in which the carriage is provided with a control roller that is disposed on the transfer route of the ink ribbon and is controlled so as to transfer the ink ribbon in the length corresponding to the printing portion at every printing by the print head in the printing action in the direction of the take-up reel and to fix the ink ribbon when the carriage returns or when transferring without printing. Between the reels, a reel control mechanism is disposed for applying a rotating force of small torque of such an extent as to slip with respect to the ribbon let-off force by the print head to the both reels in the printing action in the take-up rotating direction, and applies a rotating force of large torque to the both reels when the carriage returns in the take-up rotating direction.

4 Claims, 3 Drawing Sheets

PRINTER WITH FEED REEL AND TAKE-UP REEL WINDING

This application is a continuation of application Ser. No. 181,315, filed on Apr. 13, 1988, now abandoned.

BACKGROUND OF THE INVENTION:

This invention relates to a printer, and more particularly to a printer such as an electro-thermic printer which has a ribbon cassette mounted in a stationary state independently of the carriage, and lets off the ink ribbon from the ribbon cassette and recovers it into the ribbon cassette by means of a print head mounted on the carriage along with the reciprocal motion of the carriage in the printing direction.

The conventional printer using an ink ribbon was generally composed so as to mount the ribbon cassette on the carriage together with the print head, but the weight of the entire carriage was increased by mounting the ribbon cassette and ribbon take-up mechanism, and it was hard to move the carriage at high speed. Besides, in order to move this heavy carriage at high speed, a driving motor of a high output torque was required, and in this respect, too, the size of the carriage was enlarged, and the ribbon cassette that could be mounted on the carriage was limited accordingly.

As a means of solving these problems, meanwhile, a new mechanism was proposed in the Japanese Laid-open Patent Publication No. 58-217384. In this printer, structurally, the ribbon cassette is mounted in a stationary state independently of the carriage, and along with the reciprocal motion of the carriage in the printing direction, the ink ribbon is let off from the ribbon cassette by the print head mounted on the carriage, and is recovered into the carriage.

This printer, however, of the ribbon cassette fixed type involves the following technical problems that must be solved. That is, although the carriage can be reduced in size and weight and can be moved at high speed because the ribbon cassette is not mounted on it, but when transferring the ink ribbon, whenever the carriage is returned to the initial printing position (home position), a friction member for pressing and fixing the ink ribbon to the platen at the initial printing position is separated from the platen, and the take-up side reel is rotated in the take-up direction, and the unused ink ribbon for the portion of the length to record while the carriage makes on reciprocal stroke is preliminarily taken up on the take-up side reel. Consequently, the friction member presses and fixes the ink ribbon to the platen by means of a driving source such as magnet to define the let-off of the ink ribbon from the feed side reel, and the carriage moves in the printing direction, and along with this movement, the unused ink ribbon which has been previously taken up is let off from the take-up side reel, and is printed by the print head, and when returning as the carriage reaches the end of the printing direction, the used ink ribbon is taken up by the take-up side reel, and the same operation is repeated.

Thus, since the ink ribbon in the length necessary for one reciprocal stroke of the carriage is preliminarily taken up on the take-up side reel and the initial printing portion of this ink ribbon is fixed by the friction member, if non-printing blank portions occur continuously in the printing process, the print head is released from the ink ribbon, but these portions remain unused, and are taken up on the take-up side reel when returning the carriage. That is, since the action generally known as ribbon skip cannot be effected, the ink ribbon is consumed purposelessly. Moreover, since the ink ribbon in the printing length by one reciprocal stroke of the carriage is preliminarily taken up on the take-up reel side whenever the carriage comes to the initial printing position, it is extremely inefficient, and the take-up diameter of the ink ribbons on both reels changes every moment as the ink ribbon is taken up from the feed side reel to the take-up side reel, so that the rotation control of the motor for taking up the ink ribbon preliminarily on the take-up side reel is very difficult.

SUMMARY OF THE INVENTION:

It is hence a primary object of this invention to present a printer capable of feeding the ink ribbon in the ribbon cassette efficiently into the print head provided in the carriage.

It is another object of this invention to present a printer capable of performing ribbon skip and transferring the ink ribbon efficiently, in a system of mounting the ribbon cassette in a stationary state independently of the carriage.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above and other objects, this invention presents a printer in which a ribbon cassette having an ink ribbon wound between a feed reel and a take-up reel is mounted in a stationary state independently of a carriage, and the ink ribbon is let off from said ribbon cassette and is recovered into the ribbon cassette by means of a print head mounted on the carriage along with the movement of the carriage in the printing direction. Said carriage is provided with a control roller which is disposed on the transfer route of the ink ribbon and is controlled so as to transfer the ink ribbon in the length corresponding to the printing portion at every printing by said print head in the printing action in the direction of said take-up reel and to fix the ink ribbon when said carriage returns or when transferring without printing, and between said reels is disposed a reel control mechanism which applies a rotating force of small torque of such an extent as to slip with respect to the ribbon let-off force by said print head to said both reels in printing action in the take-up rotating direction, and applies a rotating force of large torque to said both reels when said carriage returns in the take-up rotating direction.

In the printing action, along with the movement of the carriage in the printing direction, the reels of the take-up side and feed side rotate in the anti-take-up direction by the tensile force of the print head mounted on the carriage, and the ink ribbon is let off from the ribbon cassette At this time, since the both reels are provided with a rotating force of small torque by the reel control mechanism in the take-up rotating direction, a proper tension to avoid loosening is applied to the ink ribbon being let off from the ribbon cassette. When the heating elements of the print head are selectively driven, the thermo-melting ink of the ink ribbon melted in the form of a character pattern is transferred on the printing paper, and a character is printed, and at this time the ink ribbon in the length corresponding to this printing is transferred in the take-up reel direction by the control roller.

During printing action, if non-printing blank portions are continuous, the print head is released from the ink ribbon, and the control roller fixes the ink ribbon while the carriage moves in the printing direction, so that the ink ribbon can be drawn out of the ribbon cassette That is, ribbon skip action is effected, and the ink ribbon can be saved accordingly. When the carriage reaches the terminal end in the printing direction, the print head is released from the ink ribbon, and the carriage is returned to the initial printing position while the controller is fixing the ink ribbon, and the unused portion and printed portion of the ink ribbon are taken up, respectively on the feed reel and take-up reel which are provided with a rotating direction of large torque in the take-up rotating direction by the reel control mechanism.

BRIEF DESCRIPTION OF THE DRAWINGS:

The present invention will become more fully understood from the detailed description hereinbelow and and the accompanying drawings which are given by way of illustration only, and thus are not limitative of the present invention and wherein:

FIG. 1 to FIG. 7 refer to one of the embodiments of a printer of this invention, in which:

FIG. 1 is a schematic plan view of essential parts;

FIG. 2 is a schematic plan view showing the entire printing mechanism;

FIG. 3 to FIG. 5 are schematic plan views in the printing action, ribbon skip and carriage return, respectively;

FIG. 6(*a*) to (*c*) are diagrams to show the relationship between ribbon cassette and carriage; and FIG. 7(*a*) to (*d*) are timing charts of printing motor, head motor, ribbon control motor, and paper feed motor, respectively.

Figure 1:
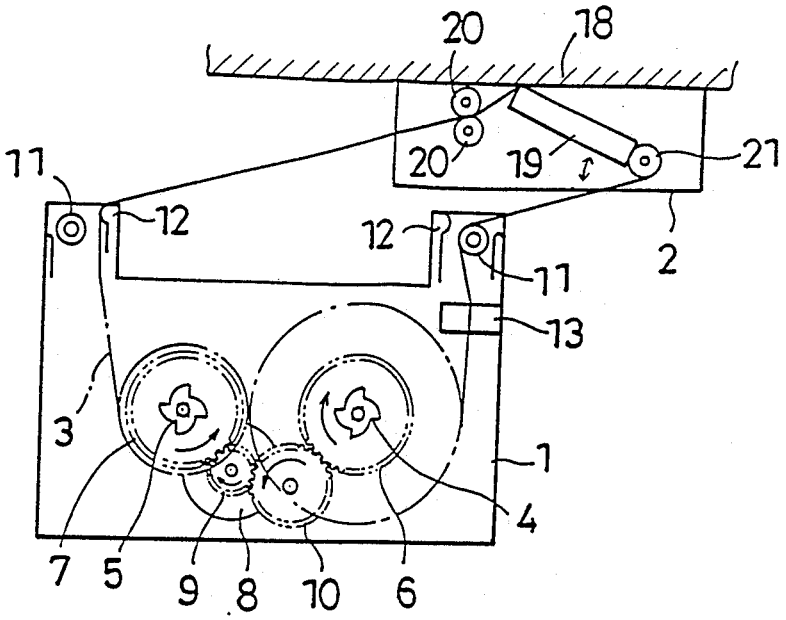

DETAILED DESCRIPTION OF THE EMBODIMENT:

A preferred embodiment of this invention is described in detail below while referring to the drawings.

Figure 2:
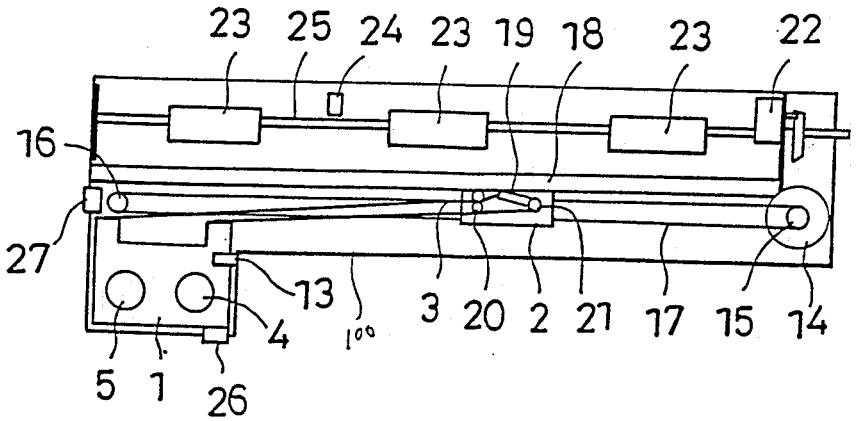

FIG. 1 is a schematic plan view of a ribbon cassette 1 and a carriage 2 which are essential parts of this invention, and FIG. 2 is a schematic drawing showing the entire printing mechanism. In these drawings, a feed reel 4 and a take-up reel 5 of an ink ribbon 3 are disposed parallel, and gears 6, 7 are affixed to these reels 4, 5 as their control mechanism. A prime gear 9 mounted on a motor shaft of a ribbon control motor 8 is meshed with the take-up side gear 7, and the rotation of this prime gear 9 is transmitted to the feed side gear 6 by way of a transmission gear 10. By the rotation of the prime gear 9 by the ribbon control motor 8 in the arrow direction in FIG. 1, a rotating force is provided in the take-up rotating direction indicated by the arrow in the same drawing, on the both reels 4, 5 through the transmission gear 10, and the feed and take-up side gears 6, 7. This rotating force is, in printing action, a small torque so as to slip with respect to the drawout force by a print head which is described below, and becomes a large torque when the carriage 2 returns. The reel torque is set so that the take-up side is larger than the feed side.

This ribbon cassette is mounted in a stationary state being independent of the carriage, on a specified plate 100 of the printer, and is detachable together therewith.

This ribbon cassette can be used on both face and back sides, being in a symmetrical configuration having a guide roller for smoothly leading out the ink ribbon outside and a guide part 12 disposed at right and left symmetrical positions, and the ribbon pancake is exchangeable. A ribbon end sensor 13 is provided at a specified position.

On the carriage 2, as shown in FIG. 2, a timing belt 17 wound on a prime side pulley 15 mounted on a printing motor 14 and a guide pulley 16 is applied, and the carriage 2 is moved reciprocally in the printing direction along a flat platen 18 by turning of this timing belt 17. This carriage 2 is provided with, for example, a print head 19 having a specified number of heating elements disposed in a matrix form and a pair of control rollers 20 and a guide roller 21. The print head 19 is disposed so as to be freely rotatable in the arrow direction by a head motor (not shown) located beneath the carriage from one end as the fulcrum, and a printing electrode part composed of said specified number of heating elements is provided at this free end. The pair of control rollers 20 are controlled in rotation so as to feed the ink ribbon 3 by the portion corresponding to the printing length in the direction to the take-up side reel 5 at every printing action of the print head 19 to the recording paper.

Three feed rollers 23 rotated by a paper feed motor 22 are attached to the flat platen 18, and a paper end sensor 24 for detecting the end of recording paper sent by each feed roller 23 is provided near a roller shaft 25 of the feed roller 23, and moreover a cassette detection switch 26 to detect whether the ribbon cassette 1 is set in place or not, and a home position switch 27 to detect the return state of the carriage 2 to the initial printing position are disposed at specified positions.

The operation of the embodiment is explained below while referring to FIG. 3 to FIG. 7.

Figure 6:
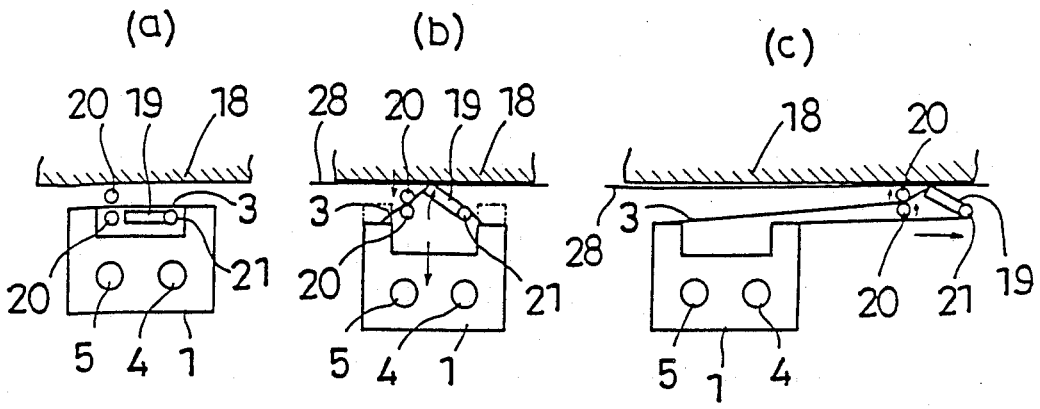

Referring first to FIG. 6, the relation between the ribbon cassette 1 and carriage 2 is explained. When loading the ribbon cassette 1, as shown in FIG. 6(*a*), the both control rollers 20 are spaced from each other at the carriage 2, and the print head 19 is also released from the platen 18, and when the ribbon cassette 1 is loaded, the ink ribbon 3 is inserted between the both control rollers 20. When this ribbon cassette 1 is set in the specified position of the printer main body, it is detected by the cassette detection switch 26, and the print head 19 turns in the arrow direction as shown in FIG. 6(*b*), and its printing electrode part contacts with the printing paper 28 by way of the ink ribbon 3, while the control roller 20 in the upper position moves to the lower position as indicated by the arrow so as to pinch the ink ribbon 3 by the both control rollers 20, and at the same time the ribbon cassette 1 is moved from the position indicated by chain line to the position indicated by solid line, thereby resulting in printing set state. When a printing operation is done, the carriage 2 on which the print head 19 and control rollers 20 are mounted is ready to move because the ribbon cassette 1 moves, and is moved in the printing direction, rightward in the drawing as shown in FIG. 6(*c*).

Figure 7:
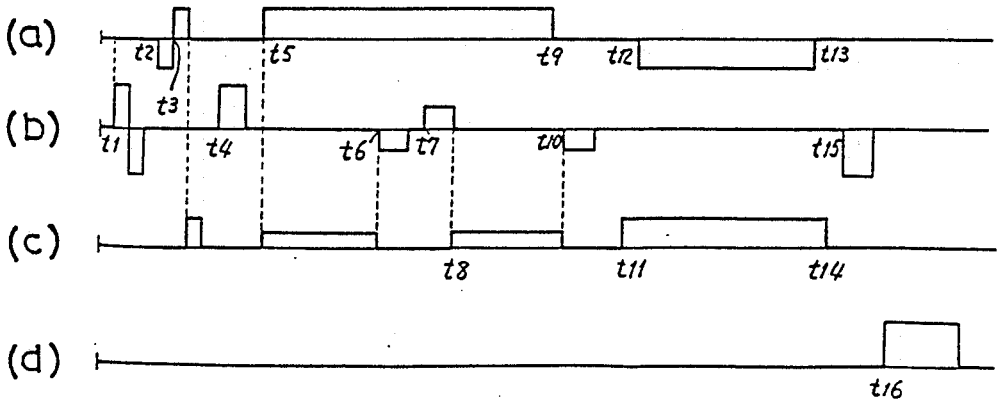

The operation is further described below by referring to the timing chart in FIG. 7. When the power is turned on at time t1 in FIG. 7(*b*), the head motor rotates the print head 19 in the direction to contact with the platen 18 as shown in FIG. 7(*b*), and immediately the print head 19 is rotated in the direction to be separated from the platen 18. After the printing electrode part of the print head 19 is thus released from the ink ribbon 3, at time t2, the printing motor 14 is rotated reversely as shown in FIG. 7(*a*), and the carriage 2 is moved toward the initial printing position, and, at time t3, when the carriage 2 returns to the initial printing position, the printing motor 15 slightly rotates in normal direction to set the carriage 2 in the specified initial printing position. At the same time, as shown in FIG. 7(*c*), the ribbon control motor 8 is rotated to move the ink ribbon 3 by a specified length. Then, at time t4, the head motor rotates to move the print head to the platen 18 side, and the print head 19 is pressed on the recording paper 28 through the ink ribbon 3, so as to be ready to print.

Figure 3:
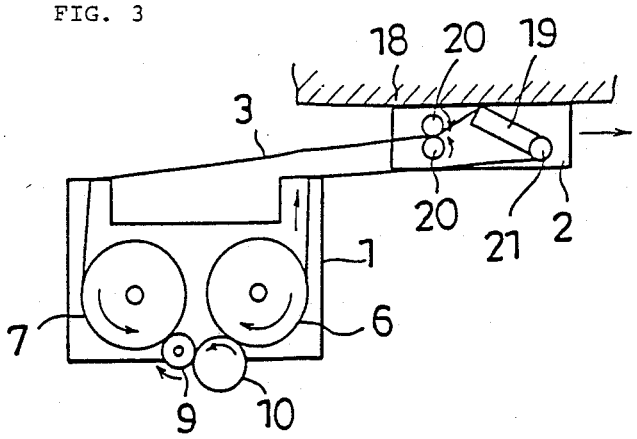

At time t5, printing action is started, and the printing motor 14 is put in normal rotation as shown in FIG. 7(*a*), and the carriage 2 moves in the printing direction as shown in FIG. 3. At this time, a rotating force in the arrow direction in the drawing is applied to the prime gear 9 by means of the ribbon control motor 8, and the feed side and take-up side gears 6, 7 are rotated in the direction to take up the ink ribbon 3 as indicated by the arrow in the same drawing. However, as shown in FIG. 7(*c*), since only a small voltage of about half of rating is applied to the ribbon control motor 8, the reel torques of the both reels 4, 5 are small, and are effective to apply tension to the ink ribbon 3 so that the ink ribbon 3 can run stably and remain taut. Besides, at every printing action by the print head 19, the both control rollers 20 rotate in the arrow direction in FIG. 3 to transfer the ink ribbon 3 by the portion corresponding to the printing length in the direction to the take-up reel 5, and when not printing, that is, when the carriage 2 moves, the ink ribbon 3 is held and fixed to draw out the ink ribbon 3 from between the both reels 4, 5.

Figure 4:
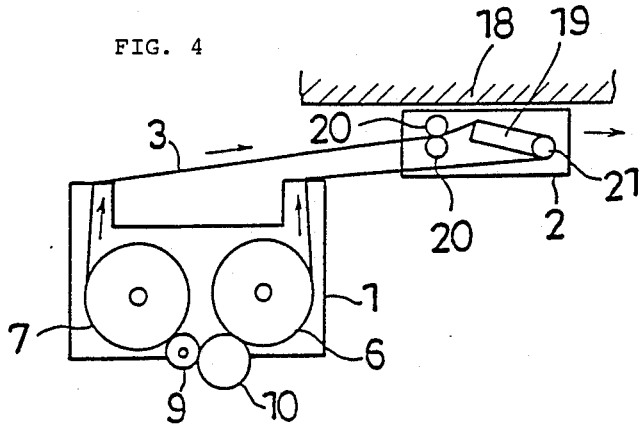

At time t6, when a printing blank signal is fed, as shown in FIG. 7(*b*), the head motor rotates the print head 19 in the direction to be separated from the platen 18. The quantity of rotation at this time is, as obvious from FIG. 7(*b*), about half of the usual rotation, and the printing electrode part of the print head 19 is slightly spaced from the recording paper 28 as shown in FIG. 4. At the same time, the ribbon control motor 8 stops rotating. In consequence, as shown in FIG. 7(*a*), the carriage 2 is moved in the printing direction as indicated by the arrow in FIG. 4 by the rotation of the printing motor 14, and, at this time, since the both control rollers 20 are holding and fixing the ink ribbon 3, the ink ribbon 3 is drawn out from the both reels 4, 5. That is, a ribbon skip action is effected, and the ink ribbon 3 is saved. When this ribbon skip action ends at time t7, the head motor rotates as shown in FIG. 7(*b*), and the printing electrode part of the print head 19 is pressed again, as the head motor rotates, to the recording paper 28 by way of the ink ribbon 3, and a small voltage is applied to the ribbon control motor 8 at time t8, and tension is applied again to the both reels 4, 5, thereby continuing the printing action.

Figure 5:
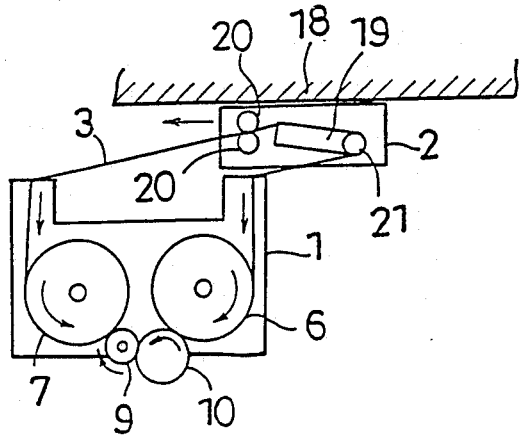

At time t9, when the carriage 2 reaches the printing end position, the rotation of the printing motor 14 stops as shown in FIG. 7(*a*), and at time t10 the head motor rotates slightly as shown in FIG. 7(*b*) to space the print head 19 slightly from the recording paper 28 as shown in FIG. 5, so that the rotation of the ribbon control motor 8 stops. Next, at time t11, as shown in FIG. 7(*c*), the ribbon control motor 8 is rotated by a specified rotating force, and immediately at time t12 the printing motor 14 is rotated reversely to return the carriage 2 as shown in FIG. 5. At this time, both control rollers 20 are pinching and fixing the ink ribbon 3, and the unused and used ink ribbons are taken up on the both reels 4, 5. By the home position sensor 27, at time t13, the rotation of the printing motor 14 is stopped as shown in FIG. 7(*a*), and later at time t14 the rotation of the ribbon control motor 8 stops as shown in FIG. 79(*c*). At t15, the head motor rotates as shown in FIG. 7(*b*) to move the print head 19 to the specified position, thereby opening a specified space against the recording paper 28, and at time t16 the paper feed motor 22 rotates as shown in FIG. 7(*d*), and the recording paper 28 is fed.

As described herein, according to the printer of this invention, aside from the advantages of the ribbon cassette fixed type, such as high speed, small size, and use of large-sized ribbon cassette, since the ink ribbon can be transferred by the portion of the printing length by the print head at the time of printing by the newly installed control rollers, there is no loss in ribbon take-up, and faster operation is realized, and moreover the ribbon skip action which was difficult in the conventional ribbon cassette type can be easily effected, and the ink ribbon can be saved, so that great economical effects can be obtained.

While only one preferred embodiment of the present invention has been described, it will be apparent to those skilled in the art that various changes and modifications may be made therein without departing from the spirit and scope of the present invention as claimed.

What is claimed is:

1. A printer comprising:

a feed reel winding one end of an ink ribbon;

a take-up reel winding the other end of said ink ribbon;

a ribbon cassette containing said feed reel and said take-up reel, said ribbon cassette being mounted stationarily on a body of the printer;

a carriage having a print head for printing by using said ink ribbon, said carriage being mounted on said body independently of said ribbon cassette and being movable in a printing direction thereof;

rotating means disposed on said body for applying a first torque to said feed reel in a direction to wind said one end of said ink ribbon and a second torque to said take-up reel in a direction to wind said other end of said ink ribbon during both of printing by said print head and returning of said carriage, said first torque and said second torque being substantially identical in magnitude with each other;

reel control means disposed on said body for controlling said rotating means such that said rotating means decreases the respective magnitudes of said first torque and said second torque with respect to a ribbon discharge force of said print head during said printing by said print head, and restores the respective magnitudes of said first torque and said second torque during said returning of said carriage.

2. The printer according to claim 1, wherein said carriage further has control rollers for transferring said ink ribbon in a length corresponding to a printing portion of every printing by said print head during said printing by said print head, and for selectively gripping said ink ribbon to hold said ink ribbon stationary relative to said print head.

3. The printer according to claim 2, wherein said gripping means is adapted to grip said ink ribbon during said returning of said carriage.

4. The printer according to claim 2, wherein said gripping means is adapted to grip said ink ribbon when a blank is encountered during said printing by said print head, and said reel control means further controlling said rotating means to fail to apply said first torque and said second torque to said feed reel and said take-up reel, respectively, when a blank is encountered during said printing.

* * * * *